United States Patent [19]

Goto et al.

[11] 3,952,717

[45] Apr. 27, 1976

[54] IGNITION SYSTEM WITH ADJUSTABLE CONTACT BREAKER CURRENT

[75] Inventors: Kenji Goto; Daisaku Sawada, both of Susono, Japan

[73] Assignee: Toyota Jidosha Kogyo Kabushiki Kaisha, Japan

[22] Filed: Oct. 24, 1973

[21] Appl. No.: 409,084

[30] Foreign Application Priority Data

Feb. 6, 1973 Japan ..... 48-14247

[52] U.S. Cl. ..... 123/179 BG; 123/148 E

[51] Int. Cl.[2] ..... F02N 17/00

[58] Field of Search ..... 123/179 BG, 148 E

[56] References Cited

UNITED STATES PATENTS

| | | | |
|---|---|---|---|
| 2,892,454 | 6/1959 | Cheetam | 123/179 BG |
| 2,955,248 | 10/1960 | Short | 123/148 E |
| 2,984,778 | 5/1961 | Race | 123/148 E |
| 3,020,904 | 2/1962 | Kerr | 123/179 BG |
| 3,240,199 | 3/1966 | Neapolitakis | 123/148 E |
| 3,259,118 | 7/1966 | Peters | 123/148 E |
| 3,340,861 | 9/1967 | Schiff | 123/148 E |
| 3,718,124 | 2/1973 | Burley | 123/148 E |
| 3,754,541 | 8/1973 | Sasayama | 123/148 E |

OTHER PUBLICATIONS

Millman and Halkias, Integrated Electronics: Analog and Digital Circuits and Systems, 1972, pp. 276–278, FIGS. 8–31.

*Primary Examiner*—Charles J. Myhre
*Assistant Examiner*—James D. Liles
*Attorney, Agent, or Firm*—Stevens, Davis, Miller & Mosher

[57] ABSTRACT

An ignition system for a gasoline engine comprising an ignition coil to which an electric current is supplied from a battery through a transistor. The transistor is so controlled as to turn on and off in response to switching off and on of a contact breaker. A current flowing through the breaker points of the contact breaker is increased temporarily in accordance with the operating conditions of the engine for preventing fouling or damage of the breaker points due to contaminants deposited thereon.

8 Claims, 2 Drawing Figures

IGNITION SYSTEM WITH ADJUSTABLE CONTACT BREAKER CURRENT

BACKGROUND OF THE INVENTION

1. Field of the Invention

This invention relates to an ignition system for a gasoline engine.

2. Description of the Prior Art

Generally, in ignition systems of the type in which the interrupting signal from the contact breaker of the distributor is amplified by a transistor, means are provided for minimizing the amount of current applied to the contact breaker so as to enhance the durability (increase the wear-life) of the contact breaker contacts. This however, gives rise to the possibility of causing fouling or poor conductivity of the contact points due to the points being stained by lubricating oil used on the sliding parts in the distributor or other factors. As a countermeasure to avoid this, attempts have been made to use a lubricating oil which is less liable to inhibit conduction; an alternative measure has been to increase the voltage or current applied to the contact points to a certain elevated level. But increased current invites a reduction in the durability of the contact points.

SUMMARY OF THE INVENTION

In view of the above, the present invention proposes an improved ignition system in which the amount of current supplied to the interrupter is increased only when the gasoline engine is operating under a certain special condition, in order to thereby improve the durability of the contact points contacts and to prevent fouling.

DESCRIPTION OF THE PREFERRED EMBODIMENTS

The invention will now be described in detail by way of some preferred embodiments thereof with reference to the accompanying drawings.

Figure 1:
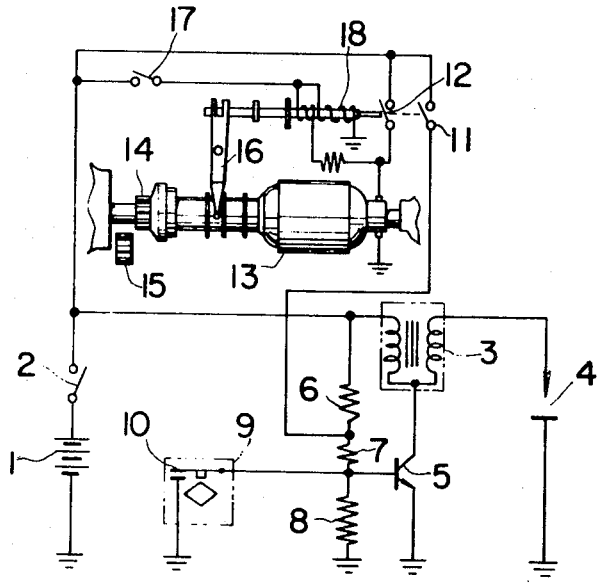
FIG. 1 is a circuit diagram showing one embodiment of the present invention.

Referring first to FIG. 1, an embodiment of the present invention is shown where the value of current supplied to the contact points is controlled in correspondence with the starting condition of the engine. A battery 1, grounded at its cathode, is connected at its anode to the primary winding of an ignition coil 3 through a main switch 2. The secondary winding of ignition coil 3 is grounded through a spark plug 4. The connecting point of the primary and secondary windings of ignition coil 3 is connected to the collector of an NPN type transistor 5, the emitter of which is connected to ground. Resistors 6 and 7 are connected in series to the base of transistor 5 to supply an electric current or voltage from the battery 1 to transistor 5 through the main switch 2. The base electrode of transistor 5 is grounded through a resistor 8 and also through a contact 10 of a contact breaker 9. The main switch 2 is connected to the junction point of resistors 6 and 7 through a switch 11 and is further connected to one of the terminals of an engine starting motor 13 through a switch 12, the other terminal of starting motor 13 being grounded. A screw-like spline, which is meshed with a pinion 14, is formed at one end of the revolving shaft of starting motor 13. Pinion 14, in turn, is arranged to mesh with a gear 15 of the engine. A lever 16 for controlling axial movement of pinion 14 is also provided.

The main switch 2 is connected to the coil of an electromagnet 18 which operates lever 16 through a starter switch 17. When starter switch 17 is closed, an electric current flows to the coil to energize electromagnet 18 to let the lever 16 pivot clockwise about its axis, causing the pinion 14 to mesh with the gear 15 and at the same time closing switches 11 and 12.

Now the engine is rotated by the starting motor 13, while the transistor 5 becomes conductive and nonconductive repetitively as the contact points 10 of the interrupter 9 is opened and closed successively. At the instant when the transistor 5 becomes nonconductive, a high voltage develops in the secondary winding of the ignition coil 3 to generate sparks in the spark plug 4 to start operating the engine. During this period, since the resistor 6 is shortcircuited by the closure of the switch 11, a high voltage is applied or a large current flows to the contact points 10.

When the rotational frequency of the engine becomes greater than that of the starting motor 13, the pinion 14 moves to the right on the spline of the motor shaft and disengages from the gear 15 of the engine. This rightward movement of the pinion 14 causes the lever 16 to swing counterclockwise against the magnetic force of the electromagnet, consequently opening the switches 11 and 12. Now the starting motor 13 is disconnected from the battery 1 and the engine proceeds into a normal operating condition. When the switch 11 is opened, the contact points 10 becomes connected to the battery 1 through both resistors 6 and 7, with the result that a a current smaller than that applied at the time of engine starting is applied to contact points 10.

Figure 2:
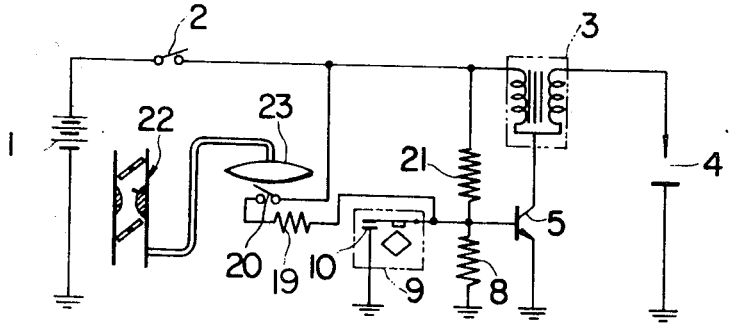
FIG. 2 is a circuit diagram showing another embodiment of the present invention.

FIG. 2 shows another embodiment where the value of current supplied to the contact points 10 is controlled in accordance with the vacuum pressure of the engine carburetor. As in the embodiment of FIG. 1, the battery 1 is connected through a main switch 2 to an ignition coil 3, spark plug 4, transistor 5, resistance 8 and contact points 10 of contact breaker 9. In this case, however, a resistance 19 and a switch 20 (which are connected in series) and a resistance 21 are connected between the main switch 2 and the base of the transistor 5; switch 20 is provided with a diaphragm 23 adapted to close switch 20 when the vacuum pressure of the engine carburetor 22 is small. Owing to this arrangement, when the vacuum pressure is large, electric current flows only to the resistors 8 and 21, and only a small current flows or a low voltage is applied to the points 10. However, if the vacuum pressure of the carburetor 22 is reduced, such as at the time of acceleration, the switch 20 is closed by the diaphragm 23 to connect the resistance 19 in parallel to the resistance 21, thereby reducing the effective resistance between battery 1 and contact point 10 in a known manner, so that the contact point 10 is supplied with a current greater than that applied when the negative suction pressure is high.

Thus, according to the present invention, as is apparent from the foregoing description, the current supplied to the contact points is increased at the time of starting of the engine or when the vacuum pressure of the carburetor is low to thereby prevent fouling or damage of the contact points, and during the other condition of engine operation, the current supplied to the interrupter contact is reduced to enhance the durability and increase the life of this contact. Therefore, the interrupter contact is less likely to be fouled or damaged, as by lubricating oil or the like and is also free from damage by high current.

What is claimed is:

1. An engine ignition system for supplying at least two different current magnitudes to the breaker points of a circuit interrupter of said ignition system, the second current magnitude being greater than the first current magnitude and sufficient to remove contaminants from said breaker points to prevent fouling or damage thereof, said ignition system comprising:

an ignition coil having primary and secondary windings; a D.C. source coupled to said primary winding; a spark plug coupled to the secondary winding of said ignition coil;

a semiconductor amplifier operated in its saturated mode and having a first grounded terminal, a second output terminal connected in common to said primary and secondary ignition coil windings and a third control terminal coupled to ground through first bias impedance means and to said D.C. source through second bias impedance means;

circuit interrupter means having a first breaker contact connected to ground and a second breaker contact connected to the junction of said first and second impedance means and said third control electrode, for intermittently making and breaking contacts between ground and said junction; and means for changing the resistance value of said second imedpance means from said first to said second magnitude as a function of a preset operating condition of said engine to increase the current magnitude supplied to said breaker contacts.

2. An engine ignition system according to claim 7, wherein said semiconductor amplifier comprises a transistor having its emitter electrode coupled to ground, its collector electrode coupled to said ignition coil windings and its base electrode coupled to the junction of said first and second impedance means and circuit interrupter means.

3. An engine ignition system according to claim 2, further comprising starter motor means coupled to said engine for starting said engine, said impedance changing means being coupled to said starter motor means to change said resistance value as a function of the operating condition of said starter motor means.

4. An ignition system according to claim 3, wherein said second impedance means comprises first and second resistors coupled in series between the base of said transistor and said D.C. source, and said starter motor means comprises a switch interposed between the junction of said first and second resistors and said D.C. source and means to close said switch when said starter motor means is energized and to open said switch when said starter motor means is de-energized.

5. An ignition system according to claim 2, wherein said engine further includes carburetor means, said impedance changing means being coupled to said carburetor means to change said resistance value as a function of the suction pressure of said carburetor means.

6. An ignition system according to claim 5, wherein said impedance changing means comprises first and second resistors and a switch coupled between the base electrode of said transistor and said D.C. source, said two resistors being connected in parallel and said switch being interposed between said first resistor and said base electrode, and said carburetor means includes a diaphragm coupled with said switch to close said switch when a preset vacuum pressure is detected by said diaphragm.

7. An ignition system according to claim 5, wherein said impedance change means comprises first and second resistors and a switch coupled between the base electrode of said transistor and said D.C. source, said two resistors being connected in parallel and said switch being interposed between said first resistor and said D.C. source, and said carburetor means includes a diaphragm coupled with said switch to close said switch when a preset vacuum pressure is detected by said diaphragm.

8. An engine ignition system according to claim 5, wherein said impedance changing means at a low vacuum in said carburetor means changes said resistance value of said second impedance means thereby to increase the current flowing through said breaker contacts to said second magnitude.

* * * * *